US005749156A

United States Patent [19]

Mokler

[11] Patent Number: 5,749,156

[45] Date of Patent: May 12, 1998

[54] DRYING APPARATUS FOR CANS USING HEATED AIR

[75] Inventor: Bernhard Mokler, Markgröningen, Germany

[73] Assignee: LTG Lufttechnische Gesellschaft mit beschrankrankter Haftung, Germany

[21] Appl. No.: 788,371

[22] Filed: Jan. 27, 1997

[30] Foreign Application Priority Data

Jan. 26, 1996 [DE] Germany ..... 196 02 784.5

[51] Int. Cl.[6] ..... F26B 25/00

[52] U.S. Cl. ..... 34/105

[58] Field of Search ..... 34/105, 106, 201, 34/207, 216, 217, 224, 225, 229, 233, 239; 219/400; 126/21 A; 226/97

[56] References Cited

U.S. PATENT DOCUMENTS 3,726,020 4/1973 Lee, Jr. ..... 34/105 X
4,259,899 4/1981 Bovenkamp et al. ..... 98/115 SB
4,492,571 1/1985 Miura ..... 34/105 X
5,271,164 12/1993 Yoshimura et al. ..... 34/105
5,353,520 10/1994 Gougé et al. ..... 34/105

*Primary Examiner*—Henry A. Bennett
*Assistant Examiner*—Steve Gravini
*Attorney, Agent, or Firm*—Ostrolenk, Faber, Gerb & Soffen, LLP

[57] ABSTRACT

A drying apparatus for surface treated cans or the like, with at least one chain conveyor which has holders for the cans. A hot air apparatus for the surface drying of the cans has an air conducting device, which directs at least one first stream of hot air at the base regions of the cans and guides at least one other second stream of air to the wall regions of the cans. The second stream of air is directed toward the can wall by at least one air conducting wall that runs obliquely in the direction toward the wall of the cans and the wall forms a wall jet of the second stream of in at least one area along the can wall.

17 Claims, 3 Drawing Sheets

DRYING APPARATUS FOR CANS USING HEATED AIR

BACKGROUND OF THE INVENTION

The invention relates to an apparatus such as a drying oven, for surface treated cans (e.g., tin cans) or the like. Such an apparatus includes at least one chain conveyor which has one or more holders for the cans and with which an air supply apparatus, such as a hot air apparatus, is associated for surface drying the cans. The hot air apparatus has an air conducting device which directs at least one first stream of hot air at the base regions of the cans and guides at least one other, second stream of air to the wall areas of the cans.

A drying oven of the above mentioned type is known from U.S. Pat. No. 5,353,520. It has a chain conveyor which runs somewhat sinusoidally or on a meander path and onto which peg like holders are fixed. The chain conveyor is carried by chain wheels and runs through the drying area of the drying oven. Drying is accomplished by a hot air apparatus which dries the freshly treated surfaces of cans held by the holders as they pass through the drying oven. In order to accurately direct the hot air at the cans and, as far as possible, to simultaneously avoid positional errors of the cans on the peg like holders, which errors are caused by the stream of hot air, an air conducting device is provided. This has a U-shaped channel which has air outlets in the region of its base from which hot air is supplied so as to converge in the base regions of the cans. Furthermore, split or partial streams of hot air emerge from openings in the two side walls of the U-shaped arrangement. These streams of hot air vertically strike the wall areas of successive cans to dry the surface treatment on the wall, for example coloring, lettering, etc., that was effected by means of a printing machine. Particularly with high speeds of hot air, disadvantageous positional errors of the can may occur which may lead to superficial damage or even to jams on the conveyor. Furthermore, the construction of the known design is relatively expensive, since lateral air supply channels have to be formed in order to be able to blow air at the wall areas of the cans. This leads to a very restricted structural shape.

SUMMARY OF THE INVENTION

The invention is therefore based on the objective of avoiding one or more disadvantages of the prior art.

The objective is achieved according to the invention in that the second stream of air is formed into a wall jet at least in one area by at least one air conducting wall that extends obliquely toward the walls of the cans. Unlike the prior art, in which air is only blown at the cans by means of free jets, in the apparatus of the invention the wall area of the can is blown against with hot air which flows at least partly along the air conducting wall, that is, the air runs along this conducting wall in particular according to the Coanda effect and the air consequently forms a stable, far travelling wall jet. Even the far distant areas of the cans are reached by this means. This application relates generally only to one side of the conveyor run for the cans, i.e., only air blown at the wall areas of the cans from one side is discussed. Preferably, air is also blown in corresponding fashion at the other side of the conveyor run, that is to say at the other sides of the wall areas of the cans and in the same way. Furthermore, over the length of the conveyor run, a plurality of wall jets are preferably formed. The transported cans emerge from the effective range of one of the wall jets and enter the effective range of the next wall jet, and so on. For the sake of simplicity, however, only the blowing of air at one side of one can is described in detail herein. By reason of the air conducting wall according to the invention, which gives rise to oblique blowing by means of wall jets, very high hot air speeds can operate without causing disadvantageous positional errors of the cans. The extremely brief drying time thus achieved allows high transport speeds and consequently a very high can throughput and/or a small structural form of the drying oven. Furthermore, this has the advantage that the air conducting wall assumes the temperature of the additional air and therefore gives off radiant heat to the cans and consequently speeds up the heating process. The wall jets preferably form a curtain which prevents the cans from being struck by cooler air which has already been in contact with other cans.

According to a further, optional aspect of the invention, the air conducting device has a partition wall having at least one opening or nozzle for the second stream of air and the air conducting wall is associated with the opening. The opening preferably has a circular cross-section, whereby, as seen over the path of transport, several such openings are provided arranged in rows. The air conducting wall is associated with the respective opening so that at least a part of the hot air forms a core jet which runs as a wall jet along the air conducting wall and only subsequently detaches itself from the wall so as then to strike the surface of a preferably stationary can. Thus, a well directed, reproducible stream of air is achieved which produces an excellent drying result with good positional stability of the cans.

The air conducting wall preferably extends from the partition wall, i.e., these two walls are joined together or are formed in one piece. The partition wall runs at a distance parallel to the base region of the can. The air conducting wall extends diagonally to the longitudinal axis of the can and consequently obliquely to the wall region of the can, whereby, in the blowing direction, the wall jet runs obliquely relative to the central longitudinal axis, so that it thus converges at the central longitudinal axis.

The free end of the air conducting wall is preferably spaced from the wall of the can, by a distance e.g., half as large as the diameter of the can. Air outlets are provided in the partition wall to act on the base areas of the cans by means of the first stream of hot air. In addition to its drying effect, the first stream of air also assures that the cans fixed on the peg shaped holders retain their fixed positions during transport. Since the second stream of air blows at an angle to the wall area of the can and to that extent also has a component which corresponds with the blowing direction of the first stream of air, the second stream of air acts in a stabilizing capacity on the position of the can.

The arrangement is preferably such that the partition wall runs at right angles or roughly at right angles to the longitudinal (central) axes of the cans.

The air conducting wall preferably forms and angle $\alpha \leqq 45°$, and preferably an angle of 10° to 25°, with a normal to the partition wall.

Finally, it is advantageous if an extension wall proceeds from the air conducting wall, at an angle $\beta$ thereto. In particular, the extension wall may be angled in relation to the air conducting wall in such a way that it runs parallel or roughly parallel to the longitudinal axes of the cans at a distance from the walls of the cans. Thus, as seen in direction of flow, the extension wall is assigned to the "rear" region of the cans and ensures that there too a very good effect is produced by the hot air, so that extremely brief drying times are achieved.

Other features and advantages of a preferred embodiment of the present invention will become apparent from the following description of the invention which refers to the accompanying drawings.

DESCRIPTION OF A PREFERRED EMBODIMENT

Figure 1:
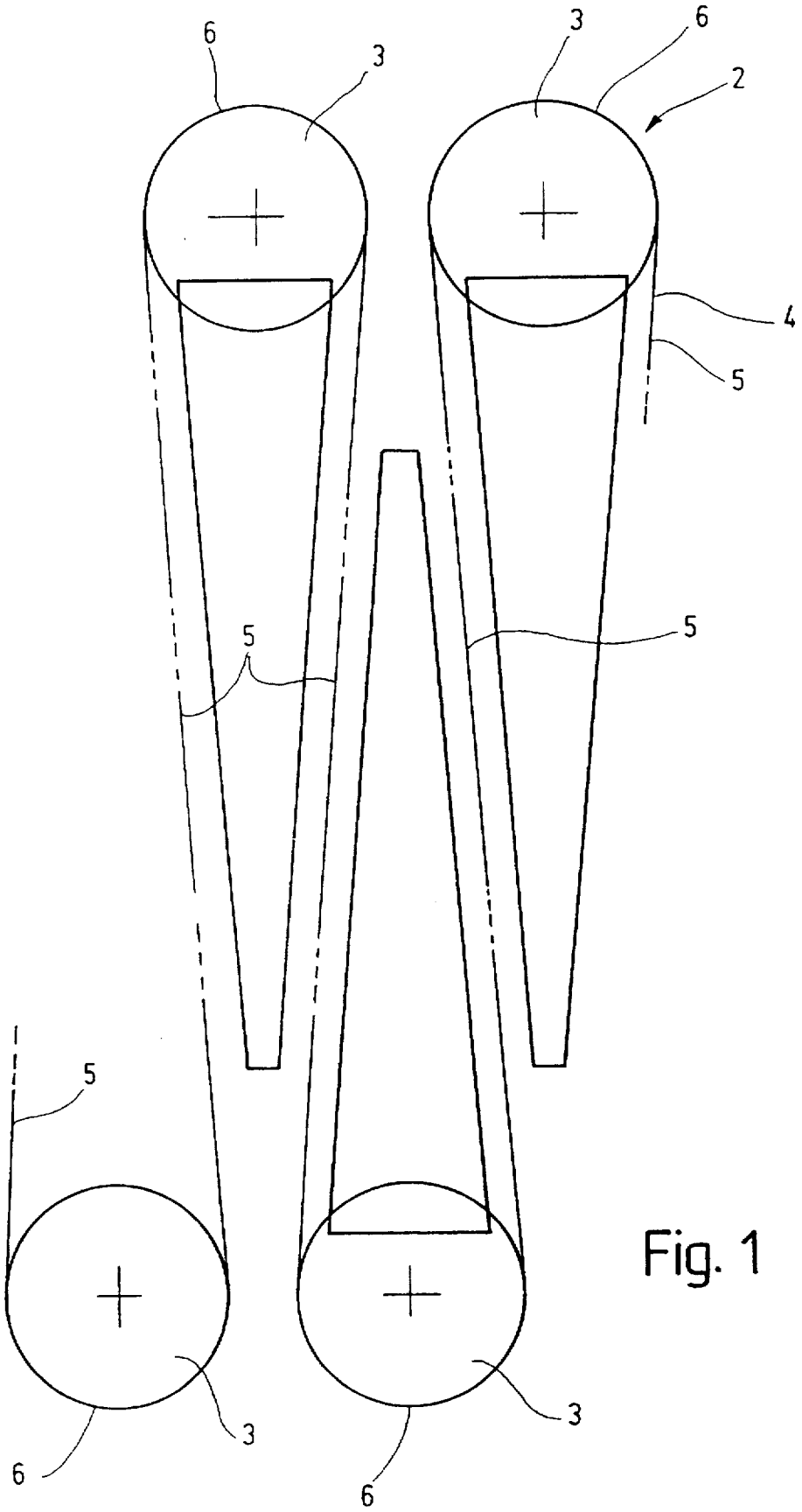
FIG. 1 shows a schematic view of a chain conveyor operation of a drying oven.
Figure 2:
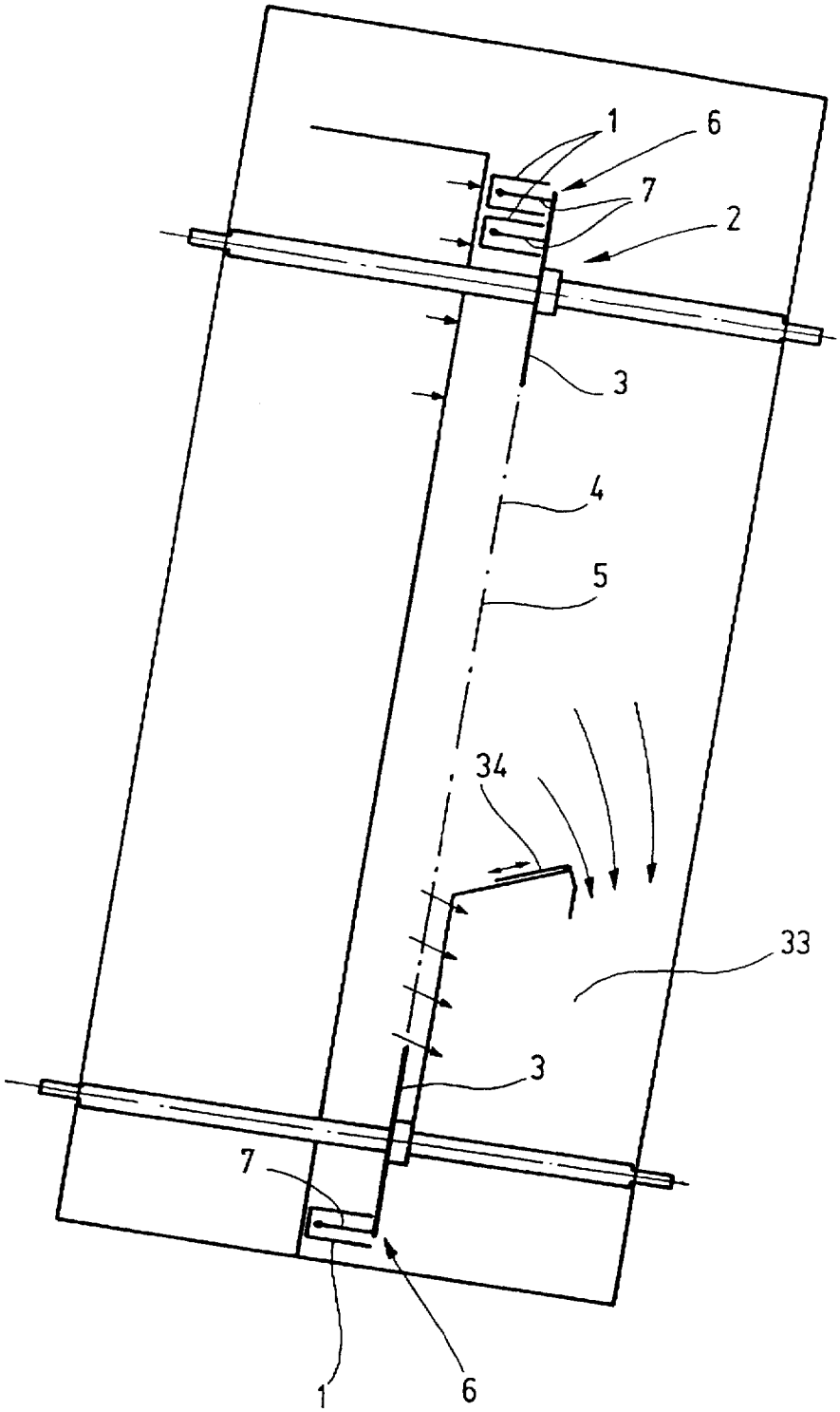
FIG. 2 shows a schematic side view of the transport zone.

FIGS. 1 and 2 schematically show areas of a drying-oven, not represented in detail, which serves for drying surface treated, for example printed, cans 1, or the like articles. The drying oven has a transport device 2, which includes several chain wheels 3 which carry a chain conveyor 4 along a meander path, so that the path has zones 5 which run upwards and downwards as well as deflection zones 6 around the wheels. Peg shaped holders 7 are arranged on the chain conveyor at intervals, one after the other, of which only two upper holders and one lower holder are represented in FIG. 2. Cans have their openings placed on the holders 7 and are moved in close succession by means of the chain conveyor 4 through the drying oven. There a hot air apparatus, which is not represented in detail, produces hot air for drying the surface treated cans. The hot air is directed at the cans 1 by an air conducting device 8 (FIG. 3).

Figure 3:
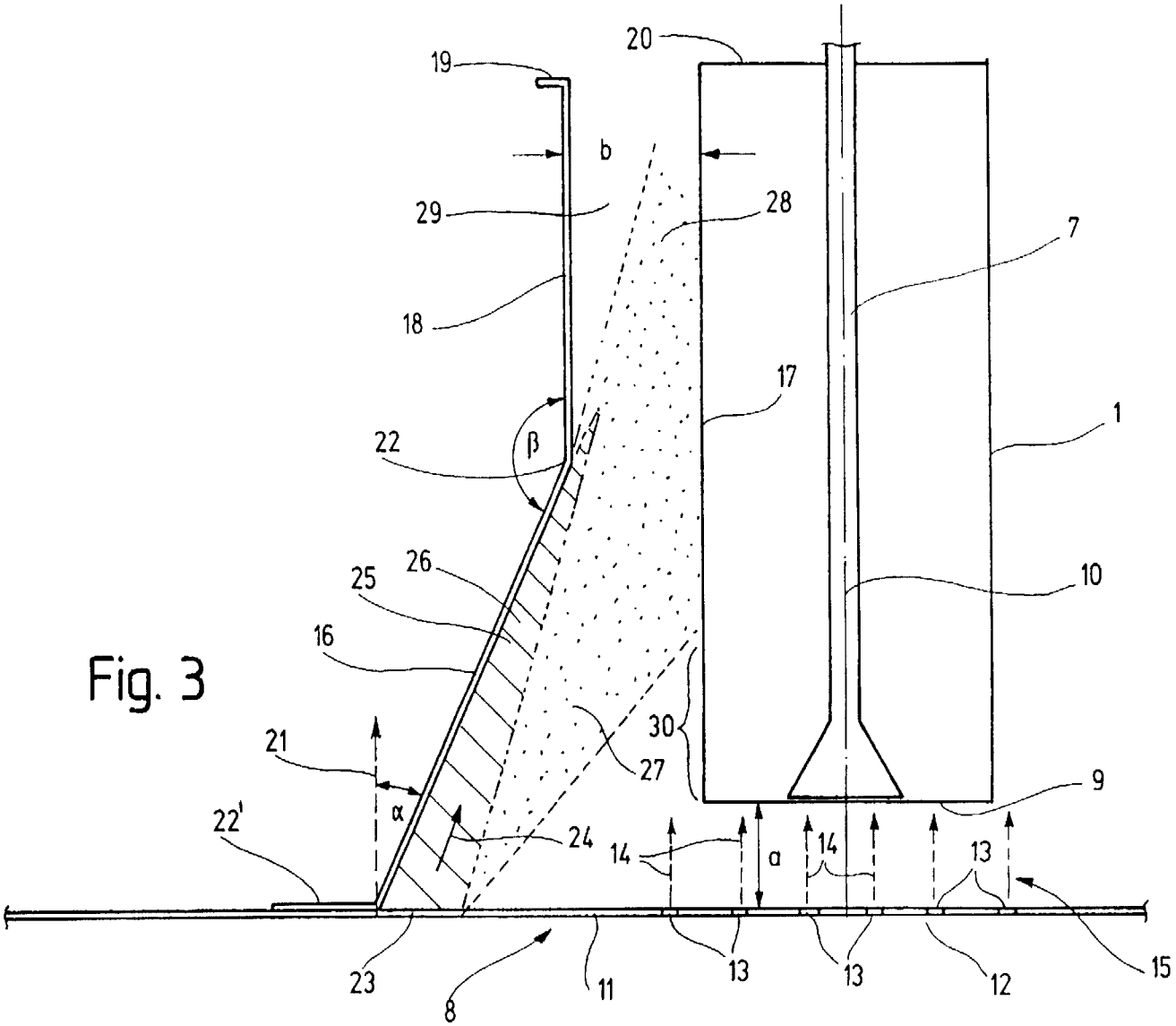
FIG. 3 shows a detailed view of the hot air treatment of a can by means of the drying oven.

In FIG. 3, the base area 9 of a can 1 held by a holder 7 lies at a small distance 'a' opposite a partition wall 11 of the air conducting device 8. The plane of a partition wall 11 preferably runs roughly at a right angle or normal to a longitudinal central axis 10 of the can 1. Hot air, produced by a hot air apparatus which is not represented, is supplied to the side 12 of the partition wall 11 facing away from the can 1. The partition wall 11 has a plurality of air passages 13 which lie opposite the base area 9 of the can 1. A corresponding number of streams of hot air 14 emerge from the air outlets 13. These streams of hot air 14 together form a first stream of air 15 which, on the one hand, dries the can in the area acted upon and, on the other hand, produces a stabilizing effect upon the position of the can 1 on the holder 7 by pressing the can in the direction of its fixation on the holder 7.

In an area located to one side of the can 1, the air conducting device 8 has an air conducting wall 16 which is connected with the partition wall 11. The air conducting wall 16 extends obliquely towards the wall 17 of the can 1.

An extension wall 18 extends from, and preferably is integral with, the air conducting wall 16. The extension wall 18 preferably extends at such an oblique angle to the air conducting wall 16 that it lies parallel or roughly parallel to the wall 17 of the can 1. The free end region 19 of the extension wall 18 preferably includes a flange as shown. The free end region 19 terminates roughly at the height of the opening 20 into the can 1. The flange is formed so that it points away from the can 1. The distance "b" between the extension wall 18 and the wall 17 of the can 1 is about half as large as the diameter of the can. In relation to a normal 21 to the plane of the partition wall 11, the air conducting wall 16 forms an angle $\alpha$ which is smaller than 45°, and preferably for instance 20°. An angle $\beta$ is formed between the air conducting wall 16 and the extension wall 18. The corner 22 formed by the abutment of air conducting wall 16 and extension wall 18 likes roughly at half the height of the longitudinal extension of the can 1. Air conducting wall 16, extension wall 18 and end region 19, together with a fixing area 22', are preferably formed in one piece by means of a suitably angled sheet of metal. The fixing area 22' rests on the partition wall 11 and is fixed there by suitable means. Adjacent to the air conducting wall 16 (on its side facing the can 1), the partition wall 11 has an opening 23, possibly also in the form of a slot. As mentioned above, several such openings 23 are preferably provided over the longitudinal extension of the path of transport of the cans 1. These openings are arranged in rows in the partition wall 11. However, for simplicity, only one of these openings 23 is detailed below. Depending on the impact pressure of the hot air prevailing on the side 12 of the wall 11, a second stream of hot air 24 emerges from the opening 23. This second stream of air 24 strikes the wall 17 at an angle to the direction of central longitudinal axis 10. Since the air conducting wall 16 is adjacent to the opening 23, part of the second stream of air 24 forms a core jet 25, which flows against the air conducting wall 16 and in this way is guided a long way towards the can 1 without the stream of air "breaking up". In this respect, part of the second stream of air 24 forms a wall jet 26, which is represented in FIG. 3 as a cross hatched triangular area. A certain proportion 27 of the hot air detaches itself from the wall jet 26 in the direction of the wall 17 of can 1, so that the area of the wall 17 of the can 1 facing the partition wall 11 is acted upon accordingly. The same applies to the central area of the wall 17, which lies at about the height of the corner 22. Since the wall jet 26 causes the hot air to travel a long distance forward, the rear area of the wall 17 of the can 1 is also acted upon by a corresponding portion 28 of the hot air, so that altogether an optimally quick and effective drying of the surface treated can 1 is accomplished. Among other things, the space 29 formed between the wall 17 and the extension wall 18 is also responsible for the distribution of air in the rear area. The region 30 of the wall 17 of the can 1 located relatively close to the partition wall 11 is preferably acted upon by hot air flowing from air outlets 13 in the partition wall 11. For this purpose, corresponding outlets 13 lie at a distance from the central longitudinal axis 10 which is larger than the radius of the can 1. It can, however, be arranged that alternatively or in addition a part of the second stream of air 24 also acts on this area. This is dependent on the shape of the opening 23 and also on the position and incline of the air conducting wall 16. A person skilled in the art is in a position to vary the optimum drying conditions.

FIG. 2 shows an outgoing air channel 33 for the return of the hot air to the hot air apparatus. The inlet cross section of the outgoing air channel 33 can be varied by means of a slide valve 34. As FIG. 2 shows, the outgoing air channel 33 does not extend over the full height of the conveying distance of the cans, but only over a lower partial section (approximately ⅓ of the height). As a result, there is optimum easy access to the chain conveyor 4.

Corresponding air conducting walls can be arranged in the deflection region of the chain wheels 3 so that the mentioned advantages can also arise in such regions.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A drying apparatus for drying surface treated cans, the apparatus comprising:

a can conveyor having at least one can holder thereon adapted for supporting a can with the base region of the can facing in one direction;

a hot air supply apparatus for surface drying a can, the hot air apparatus comprising:

a first air conducting device for directing at least one first stream of hot air at the base region of the can;

at least one air conducting wall for directing at least one second stream of air, the air conducting wall including at least a portion extending obliquely toward the wall of the can in the direction from below the base of the can toward the top of the can, the air conducting wall being spaced a distance laterally away from the wall of the can so that the air conducting wall directs the second stream of air to form a wall jet at least in one area.

2. The apparatus of claim 1, wherein the air conducting device includes means for directing the second stream of air against the air conducting wall.

3. The apparatus of claim 2, wherein the air conducting wall is spaced from the wall of the can.

4. The apparatus of claim 3, wherein the air conducting wall is spaced at a distance about half as large as the diameter of the can from the wall of the can.

5. The apparatus of claim 1, wherein the air conducting device further comprises a partition wall spaced away from the base of the can, and the partition wall having at least one passage therethrough for the second stream of air and directed at the air conducting wall.

6. The apparatus of claim 5, wherein the partition wall has a second passage therethrough for the first stream of air to direct it at the base region of the can.

7. The apparatus of claim 5, wherein the partition wall extends at least approximately at a right angle to the longitudinal axis of the can.

8. The apparatus of claim 5, wherein the air conducting wall extends from the partition wall toward and past the base of the can toward the top of the can and obliquely toward the wall of the can.

9. The apparatus of claim 8, wherein the air conducting wall is spaced from the wall of the can.

10. The apparatus of claim 8, wherein the partition wall extends at least approximately at a right angle to the longitudinal axis of the can.

11. The apparatus of claim 10, wherein the air conducting wall is oriented to form an angle of less than 45° with a normal to the partition wall.

12. The apparatus of claim 11, wherein the angle is in the range of 10° to 25° to a normal to the partition wall.

13. The apparatus of claim 11, wherein the air conducting wall includes an end region thereof and an extension wall extending up from the end region of the air conducting wall and further toward the top of the can, the extension wall and the air conducting wall meeting at an angle such that the extension wall is generally more parallel to the axis of the can than the air conducting wall.

14. The apparatus of claim 13, wherein the extension wall runs at least approximately parallel to the longitudinal axis of the can and is spaced a distance from the wall of the can.

15. The apparatus of claim 1, wherein the can has an open top and the support for the can is shaped to extend into the can against the base of the can, so that the first stream of air at the base pushes the can onto the support.

16. The apparatus of claim 1, wherein there are a plurality of the holders on the conveyor, the holders are arranged one after the other and are shaped, positioned and oriented to move the cans along a pathway past the hot air supply apparatus, whereby each of the cans in turn is exposed to the first and second air streams of the hot air apparatus.

17. The apparatus of claim 16, wherein there are a plurality of the hot apparatus arranged along the path of the conveyor through the drying apparatus, so that each of the cans may be exposed to more than one of the hot air apparatus.

* * * * *